US008573886B1

(12) United States Patent
Taylor, Jr.

(10) Patent No.: US 8,573,886 B1
(45) Date of Patent: Nov. 5, 2013

(54) CURB FORMING APPARATUS

(75) Inventor: Edgar Josiah Taylor, Jr., Cottonwood, CA (US)

(73) Assignee: Contech International, LLC., Portland, OR (US)

( * ) Notice: Subject to any disclaimer, the term of this patent is extended or adjusted under 35 U.S.C. 154(b) by 14 days.

(21) Appl. No.: 13/374,855

(22) Filed: Jan. 19, 2012

(51) Int. Cl.
*E01C 11/22* (2006.01)

(52) U.S. Cl.
USPC ..... 404/98; 404/105

(58) Field of Classification Search
USPC ..... 404/101, 105, 106, 98
See application file for complete search history.

(56) References Cited

U.S. PATENT DOCUMENTS

| | | | | |
|---|---|---|---|---|
| 2,181,320 | A | 11/1939 | Flynn | |
| 2,393,954 | A | 2/1946 | Baker | |
| 2,664,794 | A | 1/1954 | Evans | |
| 2,864,452 | A | 12/1958 | Guntert | |
| 3,188,928 | A | 6/1965 | Guntert | |
| 3,190,196 | A | 6/1965 | Guntert | |
| 3,292,511 | A * | 12/1966 | Cheney | 404/84.2 |
| 3,354,801 | A | 11/1967 | Hanson | |
| 3,423,859 | A | 1/1969 | Swisher | |
| 3,477,354 | A | 11/1969 | Rink | |
| 3,540,359 | A | 11/1970 | Swisher | |
| 3,541,933 | A | 11/1970 | Carpenter | |
| 3,602,112 | A | 8/1971 | Burks | |
| 3,604,512 | A | 9/1971 | Carter | |
| 3,606,827 | A * | 9/1971 | Miller et al. | 404/84.2 |
| 3,635,131 | A | 1/1972 | Larsen | |
| 3,710,695 | A * | 1/1973 | Miller et al. | 404/98 |
| 3,749,504 | A * | 7/1973 | Smith | 404/84.2 |
| 3,779,661 | A | 12/1973 | Godbersen | |
| 3,779,662 | A * | 12/1973 | Smith | 404/98 |
| 3,936,211 | A * | 2/1976 | Miller et al. | 404/104 |
| 4,093,410 | A * | 6/1978 | Miller | 425/59 |
| 4,197,032 | A * | 4/1980 | Miller | 404/98 |
| 4,789,266 | A * | 12/1988 | Clarke et al. | 404/96 |
| 4,808,026 | A * | 2/1989 | Clarke et al. | 404/90 |
| 5,662,431 | A * | 9/1997 | Colvard | 404/105 |
| 6,109,825 | A * | 8/2000 | Yon | 404/84.05 |
| 6,890,123 | B2 * | 5/2005 | Piccoli | 404/72 |
| 8,068,962 | B2 * | 11/2011 | Colvard | 701/50 |

* cited by examiner

*Primary Examiner* — Matthew D Troutman
(74) *Attorney, Agent, or Firm* — Thomas R. Lampe

(57) ABSTRACT

A slip forming curbing machine includes a hopper and slip former selectively raised or lowered as a unit relative to a wheeled frame. A grader is movably connected to and supported by the frame, the grader having a grader portion selectively slidably movable to extend beyond the frame. Sensors attached to and extending from the frame are used to control movement of the machine and operation of several components, including mechanism for raising and lowering the hopper and slip former.

12 Claims, 9 Drawing Sheets

CURB FORMING APPARATUS

TECHNICAL FIELD

This invention relates to self-propelled slip forming apparatus for preparing a curb site and forming a concrete curb at the curb site.

BACKGROUND OF THE INVENTION

Machines, commonly called "curbers", for forming curbs through utilization of slip formers to form the curbs in situ are well known. The slip formers receive wet concrete from a hopper of the moving machine and continuously and simultaneously deposit the wet concrete on the ground and mold it to the desired shape, the curb sometimes being formed with the curb in the shape of a curb gutter, the shape being determined by the internal configuration of the slip former.

The following patent documents are believed to be representative of the present state of the prior art in this field: U.S. Pat. No. 3,779,661, issued Dec. 18, 1973, U.S. Pat. No. 3,188,928, issued June, 1965, U.S. Pat. No. 3,604,512, issued September, 1971, U.S. Pat. No. 3,354,801, issued November, 1967, U.S. Pat. No. 2,181,320, issued November, 1939, U.S. Pat. No. 3,423,859, issued January, 1969, U.S. Pat. No. 2,393,954, issued February, 1946, U.S. Pat. No. 2,664,794, issued January, 1954, U.S. Pat. No. 2,864,452, issued December, 1958, U.S. Pat. No. 3,540,359, issued November, 1970, U.S. Pat. No. 3,190,196, issued June, 1965, U.S. Pat. No. 3,477,354, issued November, 1969, U.S. Pat. No. 3,541,933, issued November, 1970, U.S. Pat. No. 3,602,112, issued August, 1971, U.S. Pat. No. 3,635,131, issued January, 1972. A curb former formerly made available by ProCurb, LLC, Portland, Oreg. is also considered prior art.

The invention disclosed and claimed herein also relates to a self-propelled slip forming apparatus for forming a concrete curb. The term "curb" as employed herein is not limited to curbs per se, but also encompasses curb gutters. The apparatus incorporates numerous advantageous features as compared to the prior art, providing an arrangement that is relatively inexpensive and of simpler construction as compared to prior art approaches. Among other novel features, the invention incorporates a grader which is utilized to level the ground upon which the curb is to be placed. The invention is also characterized by its versatility and ease of use. The apparatus disclosed herein shares some features with the ProCurb curb former referenced above that I invented and the subject of U.S. patent application Ser. No. 12/455,122, filed May 27, 2009. The slip forming apparatus disclosed herein is compact and stable and also allows ready replenishment of wet concrete in the hopper thereof from any side. Both forward and backward steering is possible. Considerably less suspension structure is employed than utilized by prior art approaches. These and other advantages will be apparent with reference to the specification and drawings hereof.

DISCLOSURE OF INVENTION

The present invention relates to a self-propelled slip forming apparatus for forming a concrete curb on a selected curb site on the ground and which includes a rigid frame and front wheels and back wheels supporting the frame.

The apparatus also incorporates a hopper having a hopper interior for receiving wet concrete. Hopper support structure is mounted on the rigid frame supporting the hopper between the front wheels and back wheels and is selectively operable to alternatively raise the hopper relative to the rigid frame or lower the hopper relative to the frame.

A slip former is connected to the hopper for receiving wet concrete from the hopper interior and depositing the wet concrete on the ground to mold a curb during movement of the slip forming apparatus along the ground. The slip former is raised and lowered along with the hopper relative to the rigid frame.

The rigid frame includes an open topped rigid framework defining a framework interior accommodating at least a portion of said hopper, said hopper support structure including movable mechanical linkage in said open topped rigid framework attached to said hopper and at least one fluid operated cylinder connected to said mechanical linkage for moving said mechanical linkage to selectively alternatively simultaneously raise or lower said hopper and said slip former.

A grader is supported by the rigid frame between said first wheels and said second wheels extending adjacent to said hopper for grading the selected curb site preparatory to forming the concrete curb at the selected curb site.

Other features, advantages and objects of the present invention will become apparent with reference to the following description and accompanying drawings.

BEST MODE FOR CARRYING OUT THE INVENTION

Figure 1:
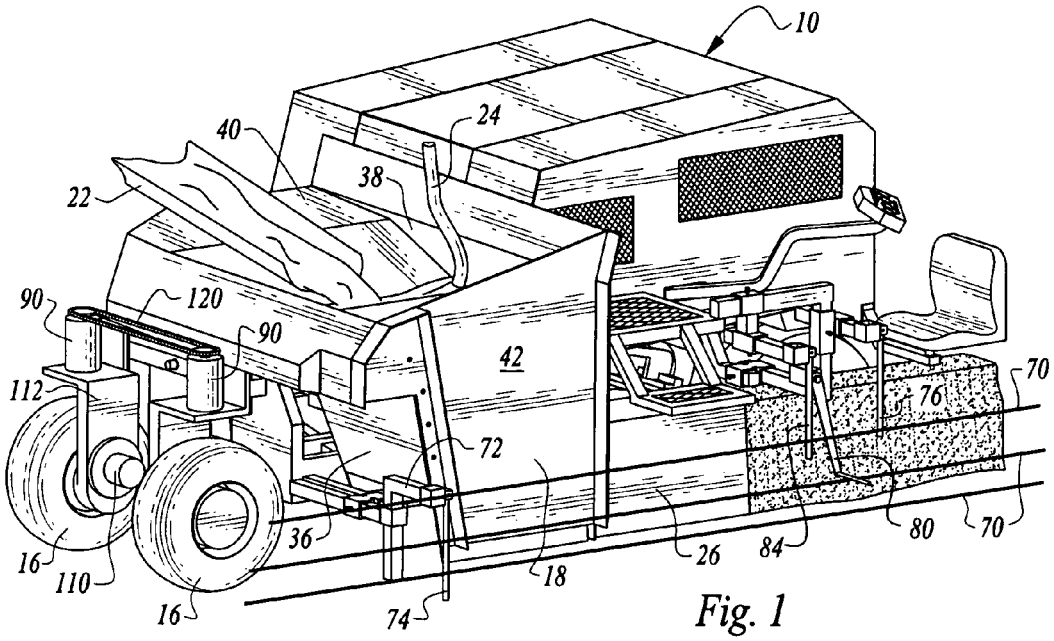
FIG. 1 is a front, perspective view of self-propelled slip forming apparatus constructed in accordance with the teachings of the present invention, portions of string lines next to the apparatus and a portion of a delivery chute being utilized to replenish wet concrete in the hopper of the apparatus.
Figure 2:
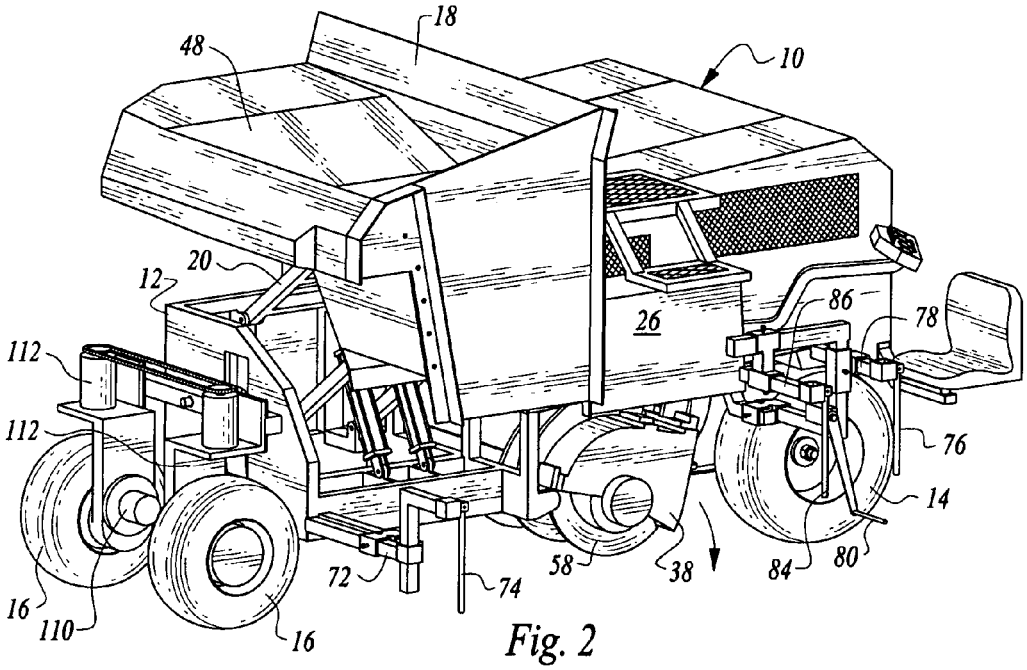
FIG. 2 is a view similar to FIG. 1, but showing the hopper and slip former of the apparatus raised, and not illustrating a delivery chute.
Figure 3:
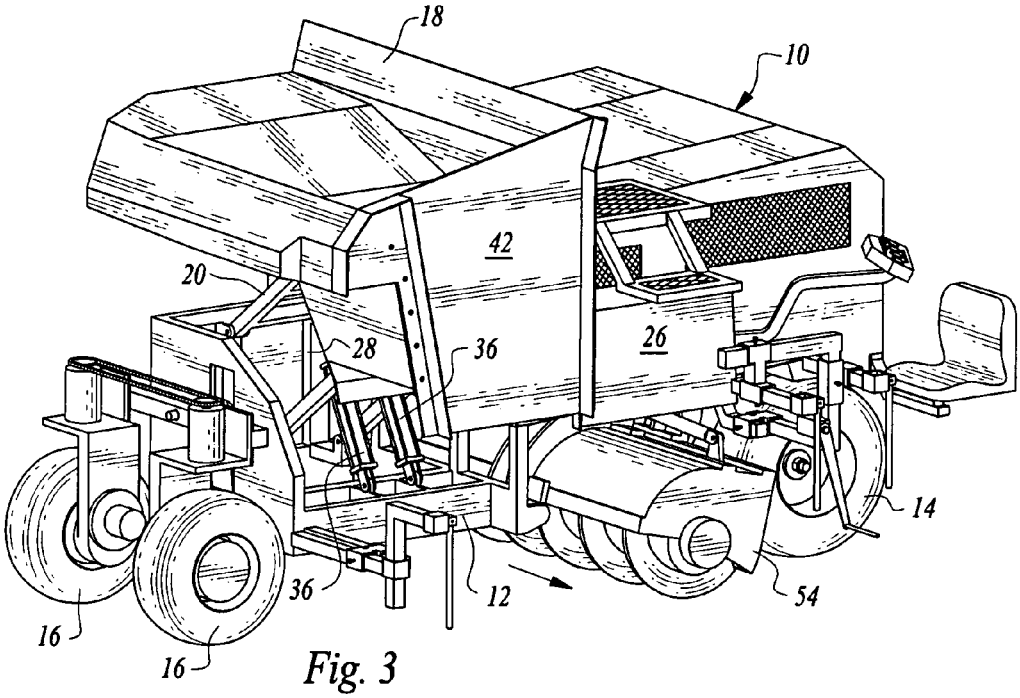
FIG. 3 is a view similar to FIG. 2, but illustrating a grader of the apparatus being moved outwardly to extend beyond the raised hopper and slip former.

Referring now to FIGS. 1-23, apparatus constructed in accordance with the teachings of the present invention is designated by reference numeral 10. Apparatus 10 is a self-propelled slip forming apparatus for forming a concrete curb. As indicated above, the term "curb" as employed herein refers not just to a curb per se, but also curb gutters as well.

Apparatus 10 includes a rigid frame 12, rear support wheels 14 and front support wheels 16 supporting the frame.

Figure 4:
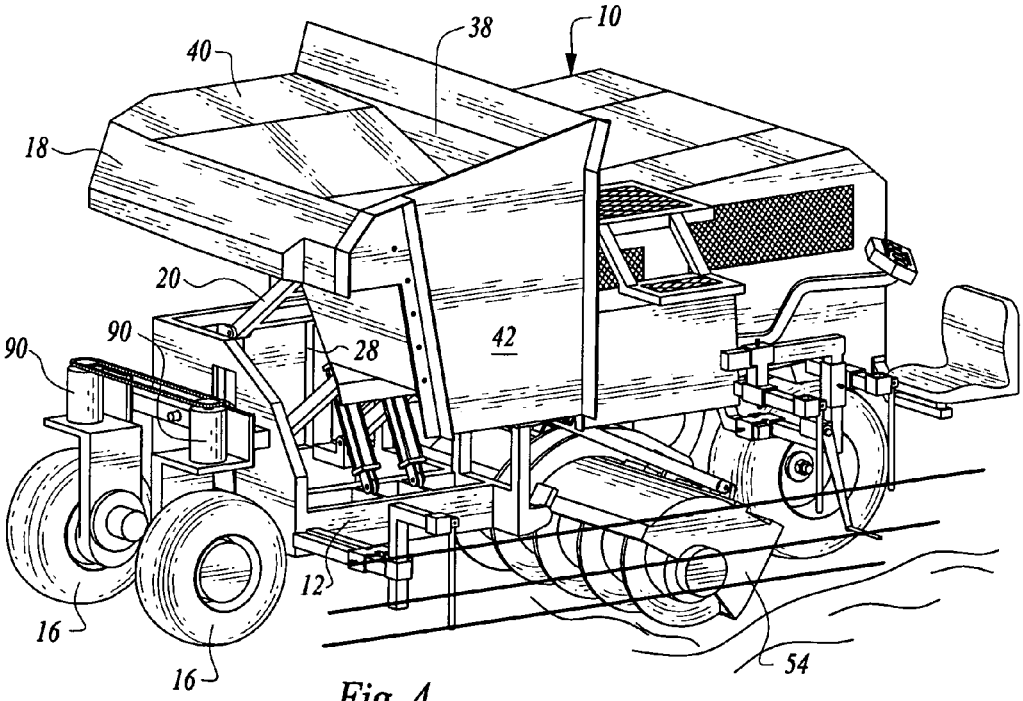
FIG. 4 is a view similar to FIG. 3, but showing the grader extended and positioned next to marker strings while grading the selected curb site.
Figure 5:
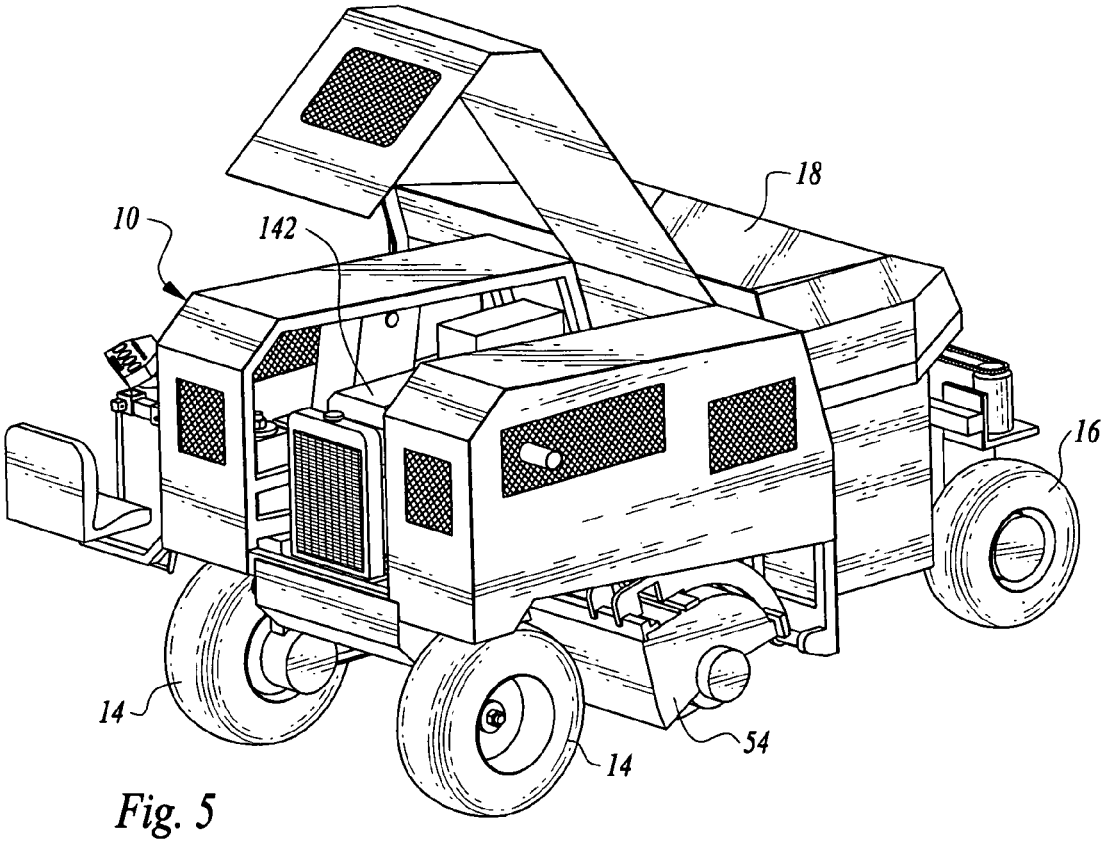
FIG. 5 is a rear, perspective view of the apparatus with the grader not extended, the hopper lowered, and a normally closed cover open to show the engine compartment.
Figure 6:
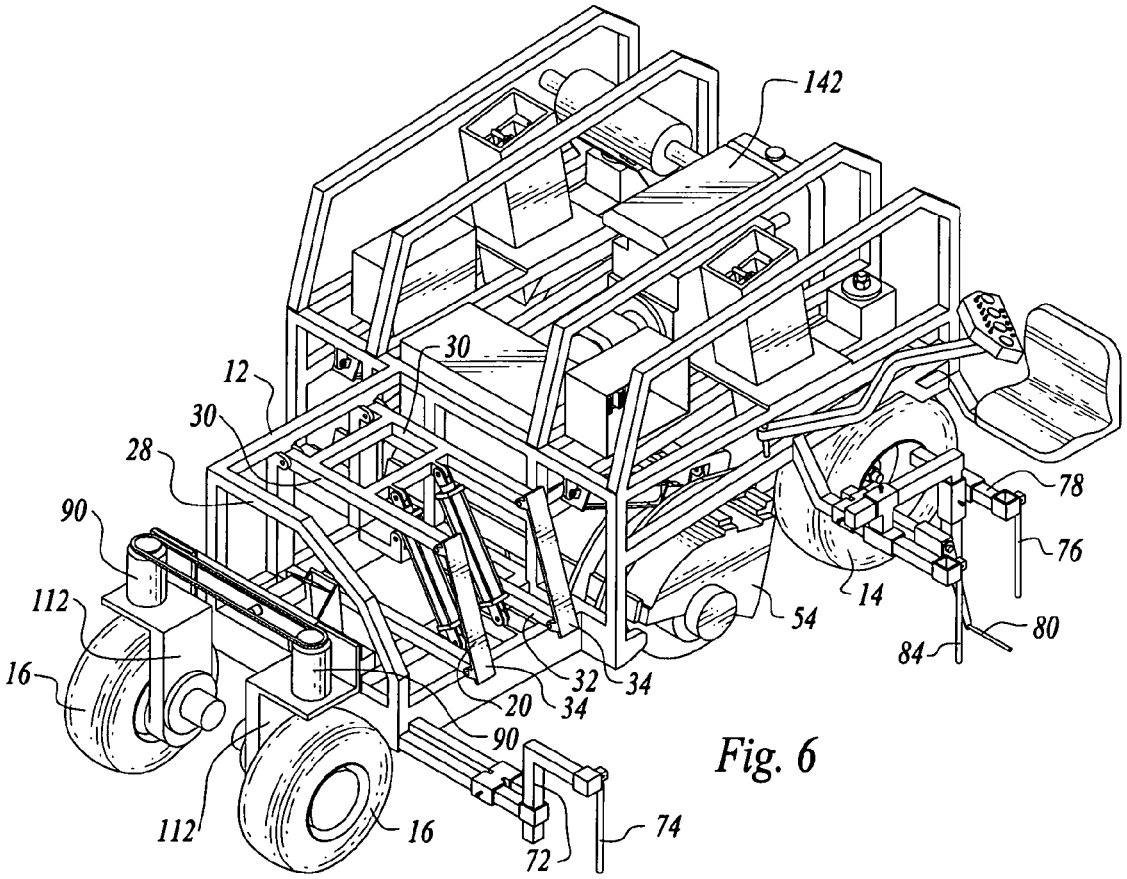
FIG. 6 is a front, perspective view of the apparatus with the hopper, slip former and hood thereof removed to show interior structure of the apparatus.

A hopper 18 having a hopper interior for receiving wet concrete is supported by hopper support structure 20 which is selectively operable to alternatively raise the hopper relative to the frame or lower the hopper relative to the frame. FIGS. 1 and 5, for example, show the hopper 18 in its lowermost position relative to the frame, while FIGS. 2, 3 and 4, for example, show the hopper in raised condition.

FIG. 1 shows wet concrete being introduced into the hopper interior by means of a chute 22 extending from a concrete truck or other source of concrete (not shown). One of the advantages of the invention is that the compact nature and configuration of the apparatus allows positioning of a concrete chute from any side of the hopper to replenish the contents. As is conventional, concrete vibrator structure 24 may be utilized in connection with the hopper to settle the concrete.

A slip former 26 is connected to the hopper 18 for receiving wet concrete from the hopper interior and for depositing the wet concrete on the ground to mold a curb during movement of the slip forming apparatus along the ground. In the present invention the slip former 26 and the hopper 18 are of unitary construction, the unit being moved up and down by the hopper support structure; that is, the slip former is raised and lowered along with the hopper relative to the frame 12.

Frame 12 includes an open topped rigid framework 28 defining a framework interior accommodating a portion of the hopper. The hopper support structure 20 includes moveable mechanical linkage in the open topped rigid framework attached to the hopper by any suitable expedient such as mechanical fasteners. More particularly, the moveable mechanical linkage includes two suspension members in the form of upper A-frame arms 30 and lower A-frame arms 32 hingedly connected to the framework 28 at the proximal ends thereof. The hopper is secured to the A-frame arms by cross members 34 pivotally connected to the distal ends of the arms 30, 32. Hydraulic cylinders 36 positioned in framework 28 are operable to move the A-frame arms and cross members from the lower position shown in FIG. 11 to the upper position shown in FIG. 12. The hopper 18, being connected to cross members 34, will always be maintained substantially level when the frame 12 is substantially level.

Hopper 18 includes two hopper side walls 36, 38, two hopper end walls 40, 42 and a hopper bottom. An opening (not shown) is formed in hopper side wall 38 immediately above the hopper bottom leading to the interior of the slip former 26, the opening preferably being located closely adjacent to hopper end wall 42 and remote from hopper end wall 40. Hopper end wall 40 has an upper inclined surface 48 for supporting the concrete chute 22 when concrete delivery is being made to the hopper. The inclined surface 48 directs concrete into the interior of the hopper. The hopper is larger and heavier at the end thereof remote from the slip former, i.e. at the location of hopper end wall 40, to balance out the weight of the filled hopper.

Figure 13:
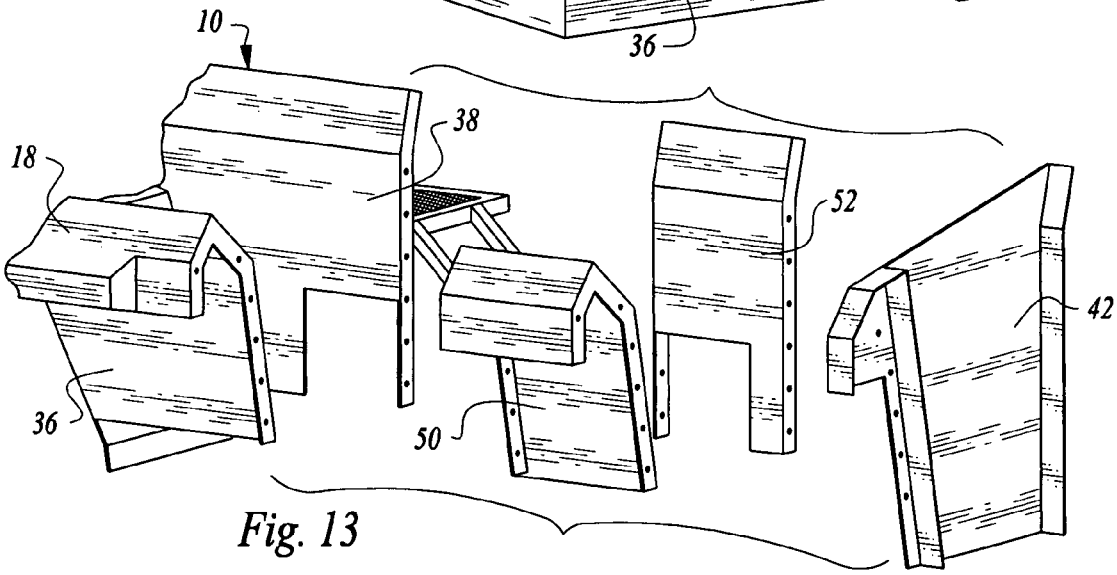
FIG. 13 is a perspective, exploded view illustrating a hopper portion with hopper end wall removed and prior to attachment of expansion structure between the hopper portion and the hopper end wall.

Hopper end wall 42 is held to the ends of hopper side walls 36, 38 by mechanical fasteners such as bolts. FIG. 13 shows the end wall 42 removed from the side walls and preparatory to attachment of side wall extensions 50, 52 to the hopper side walls. These extensions are employed to increase the capacity of the hopper, if desired. After the side wall extensions have been secured into place on the hopper side walls, the hopper end wall 42 is bolted or otherwise secured to the side wall extensions.

Apparatus 10 includes a grader 54 having a grader blade 56 and an auger 58 rotatably mounted on the grader blade. The grader is supported by the rigid frame 12 between the pair of rear support wheels 14 and the pair of front support wheels 16 and extends alongside and closely adjacent to the hopper 18. The grader is for grading the selected curb site preparatory to forming the concrete curb at the selected curb site. The grader blade 56 includes a curved grader blade wall 60 defining an interior accommodating the auger 58 with a portion of the auger extending downwardly from the interior.

The grader 54 is mounted for axial movement relative to the hopper 18 between a first position (shown in FIGS. 1 and 2, for example) wherein the grader does not extend outwardly beyond the hopper and a second position (shown in FIGS. 3 and 4, for example) wherein a portion of the grader extends beyond the hopper. In this extended position, the portion of the grader extending beyond the hopper is positioned to engage and level the selected curb site during movement of the slip forming apparatus along the selected curb site.

While it is known to employ grader augers in association with curbers, the graders are located at the front of such machines which adds to the already large overall length of such machines. Furthermore, the graders are not axially adjustable. With the arrangement of this invention, by way of contrast, the machine itself is compact and smaller, having the ability to make tighter turns and grade around radiuses in a manner not achievable with the prior art approach. The ability of the apparatus of the present invention to make tighter turns and the ability of the apparatus to cut and grade where the curb is to be formed is unattainable in the prior art. FIG. 4 illustrates the ability of the grader, when extended outwardly, to clear and level the ground where the slip former will form the curb.

When the grader is extended, the hopper and slip former are in raised position and the extended grader portion extends below the slip former.

Figure 14:
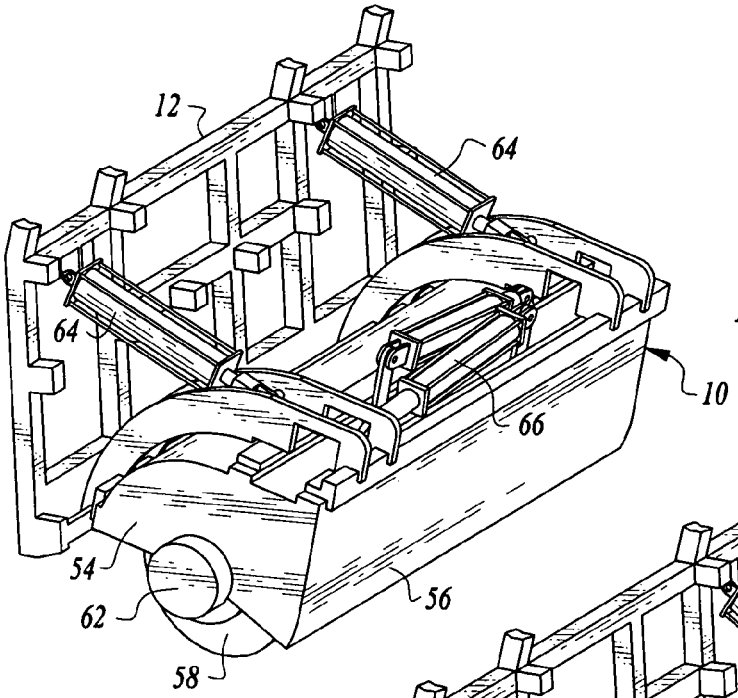
FIGS. 14-16 are perspective views illustrating the grader of the apparatus in three alternative positions.
Figure 15:
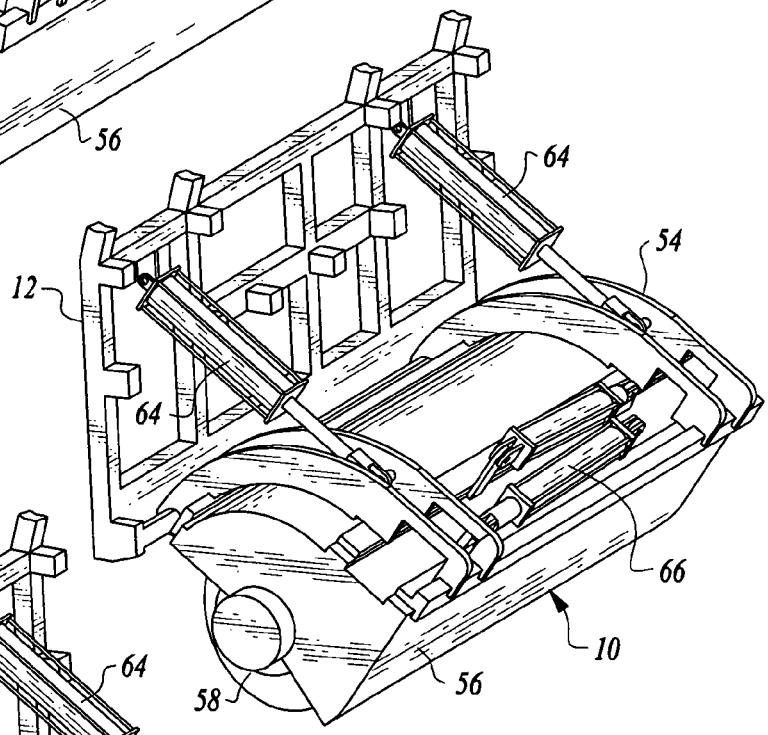
Figure 16:
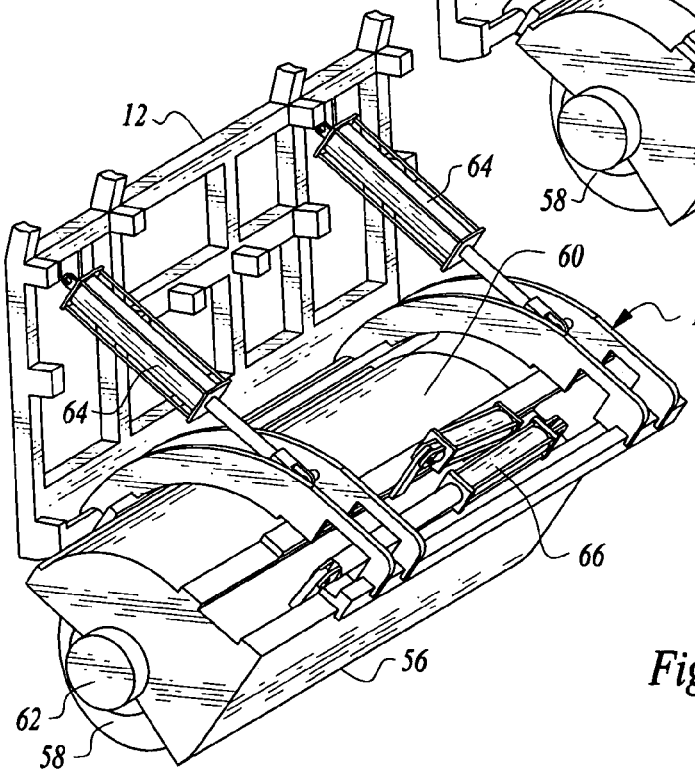

FIG. 14 illustrates details of the grader wherein it is pivotally mounted on a section of rigid frame 12. The auger 58 is rotated by a hydraulic motor 62 on an end of grader blade 56. Hydraulic cylinders 64 are utilized to tilt the grader relative to the rigid framework. A hydraulic cylinder 66 is employed to move the grader from the position shown in FIGS. 14, 15 to the position shown in FIG. 16 wherein a portion of the grader extends outwardly.

FIG. 1 illustrates apparatus 10 disposed alongside straight string lines 70 acting as guides pertaining to formation of a curb by the apparatus. The apparatus incorporates a number of sensors which cooperate with the string lines to automatically guide steering of the apparatus along the desired path of movement and to form the desired curb configuration.

Mounted on frame 12 and adjustable relative thereto is a sensor support 72 having a front steering sensor 74 at the distal end thereof for engaging a string line. A back steering sensor 76 depends from an adjustable sensor support 78 attached to the frame 12 at the back of the slip forming apparatus. A height sensor 80 is also located at the back of the apparatus, height sensor 80 extending outwardly from an adjustable sensor support 82 attached to frame 12. A radius sensor 84 is also located at the back of the apparatus 10, the radius sensor 84 supported by adjustable sensor support 86 attached to frame 12. The sensors per se may be of any suitable known type, such as sensors incorporating potentiometers for providing variable electrical control signals based on deflection by a guide string. It is known generally to use such sensors on pavers, curb frame machines and the like to guide such equipment in a forward direction along a string line and also to adjust the height of curber slip formers per se.

The slip forming apparatus may be selectively automatically steered both forward and backward along a string line. This is accomplished by employing a front steering computer when automatically steering the apparatus forward and a back steering computer when automatically steering the apparatus backward.

Figure 22:
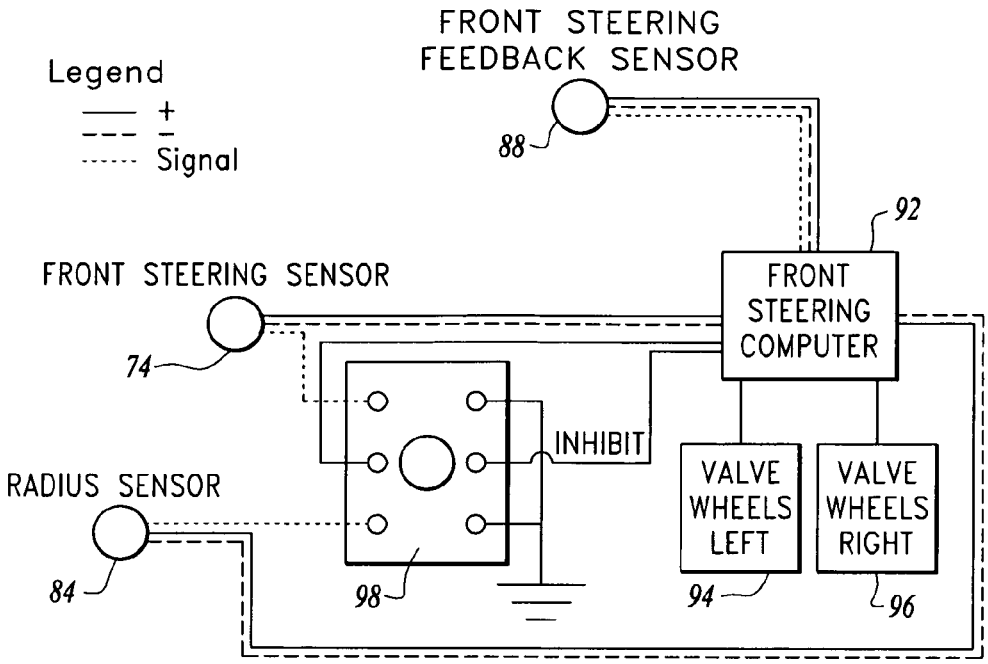
FIG. 22 is a diagrammatic presentation illustrating a front steering computer and its relationship with forward steering sensors and valves of a hydraulic system employed to steer the front support wheels.

Referring now to FIG. 22, front steering sensor 74 and a front steering feedback sensor 88 are operatively associated with front steering computer 90. The front steering feedback sensor sends a front feedback signal to the computer indicating whether the front support wheels 16 are positioned parallel to the string line sensed by front steering sensor 74 or deviates therefrom. Front steering sensor 74 transfers the information to the computer pertaining to the amount of correction relative to the distance of the sensor from the string line. The front support wheel steering structure is operated by a valve controlled hydraulic system.

More particularly, with additional reference to FIGS. 7-10, each of the front wheels 16 is turned by a hydraulic rotary actuator 90. The front steering computer 92 operates valves 94, 96 associated with both rotary actuators 90 to turn the wheels 16 either right or left to guide the apparatus 10 along the string line associated with front steering sensor 74.

A switch 98 is employed to establish the operative connection between the front steering feedback sensor 88, the front steering computer 92 and front steering sensor 74.

Switch 98 can be utilized to terminate steering based on front steering sensor 74 and allow manual steering, or the switch can be used to place the front steering computer in operative association with radius sensor 84. The radius sensor is utilized to perform only one function, and that is to guide the machine through a turn of a selected radius. This is accomplished by employing the valves 94, 96 to move the front support wheels to a desired turning angle corresponding to the selected curbing radius.

Figure 7:
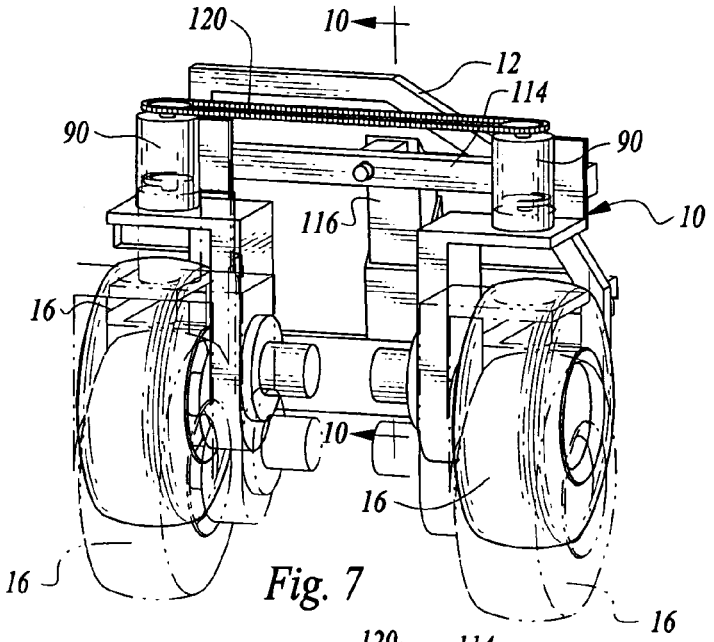
FIG. 7 is a rear, perspective view of the front wheels and related structure of the apparatus, the front wheels illustrated in raised and lowered positions.
Figure 8:
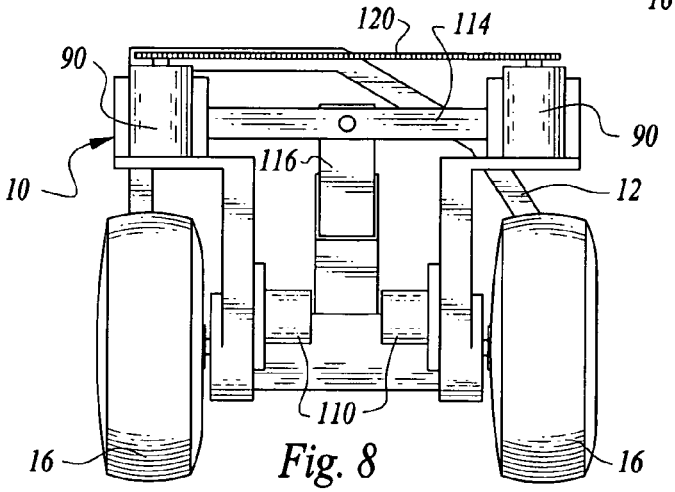
FIG. 8 is a rear, elevational view of the front wheels and related structure showing the relative positions of the front wheels on a flat horizontal surface.
Figure 9:
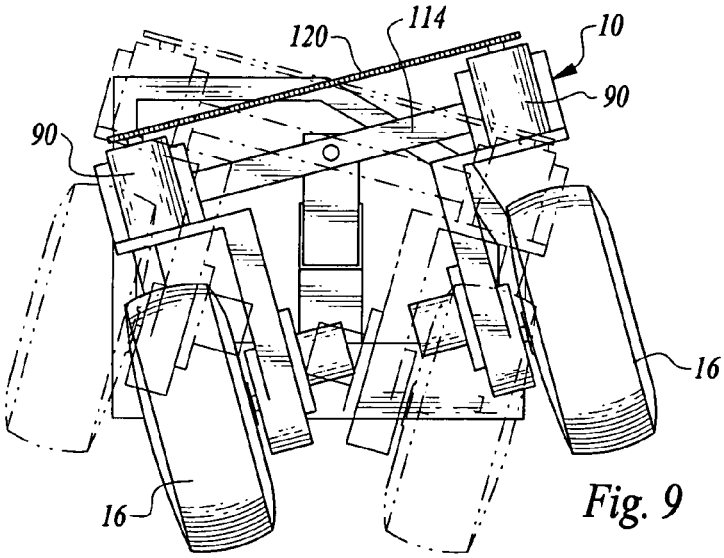
FIG. 9 is a view similar to FIG. 8 showing alternative positions of the front wheels and related structure in two alternative tilted positions, caused for example by an uneven ground surface.
Figure 10:
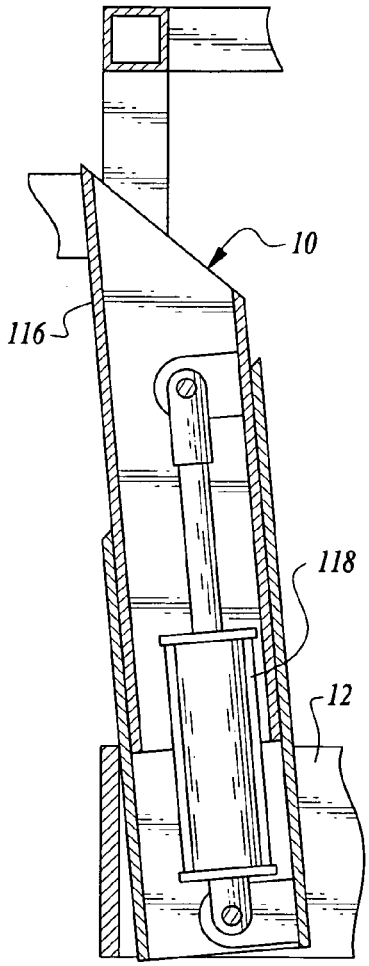
FIG. 10 is an enlarged, cross-sectional view taken along line 10-10 in FIG. 7.
Figure 11:
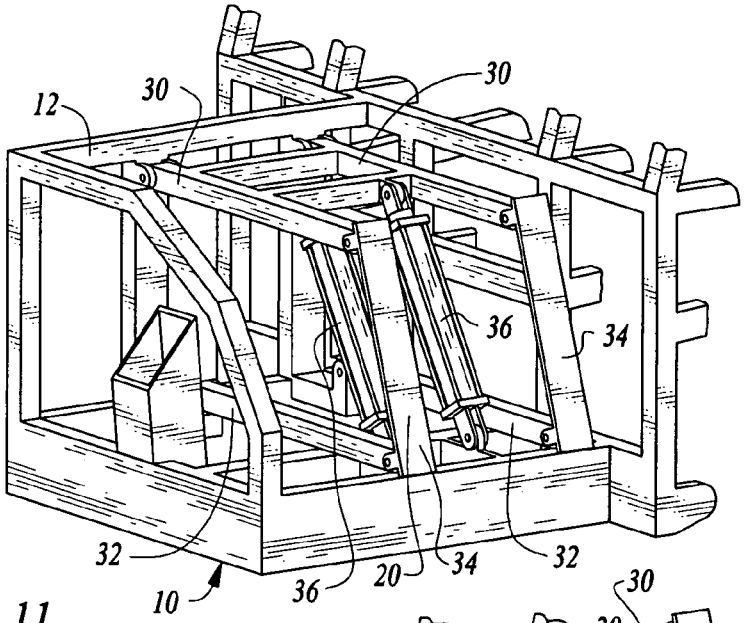
FIG. 11 is a perspective view illustrating hopper support structure of the apparatus as positioned when the hopper (not shown) is in its lowermost position.
Figure 12:
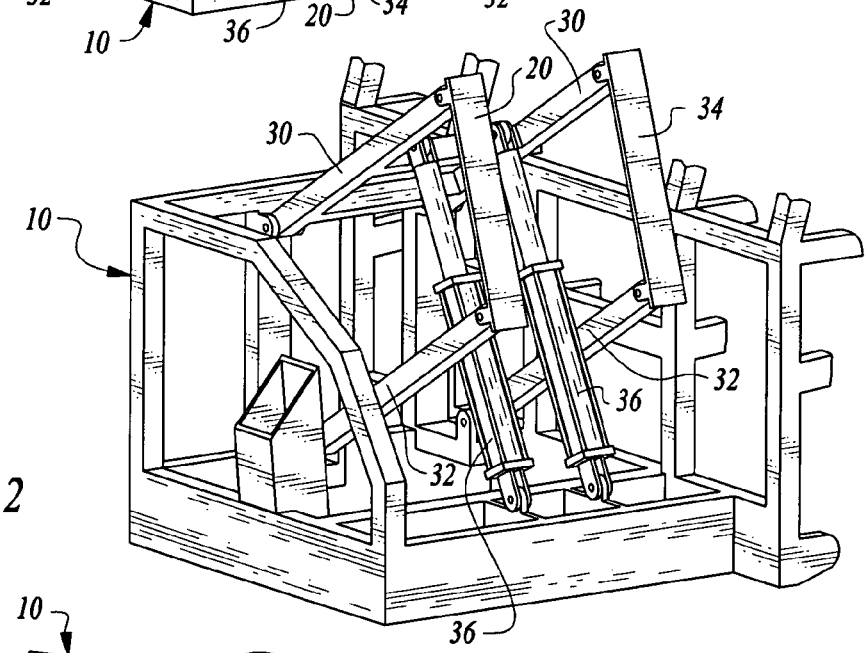
FIG. 12 is a view similar to FIG. 11 illustrating the hopper support structure when the hopper (not shown) has been elevated to its uppermost position.

The front support wheels 16 are independently hydraulically powered by hydraulic motors 110 to move the apparatus 10. The wheels 16 and hydraulic motors 110 are connected to front wheel supports 112, upon which are positioned the rotary actuators 90. The front wheel supports and rotary actuators are located at opposed ends of a beam 114 which is pivotally connected at the center thereof to a beam support 116 which in turn is attached to the arm of a hydraulic cylinder 118. The housing of the hydraulic cylinder is attached to frame 12. The hydraulic cylinder is employed to move the beam front wheel supports, front wheels and rotary actuators up or down as depicted in FIG. 7, which shows these structural elements in raised and lowered positions.

The tilting of the beam and front wheels compensates for changes in the ground surface configuration and eliminates tilting of the frame and hopper that might otherwise occur.

An endless chain or belt 120 interconnects rotary actuators 90 to prevent either one of the rotary actuators from overpowering the other so that the front wheels turn uniformly.

Figure 23:
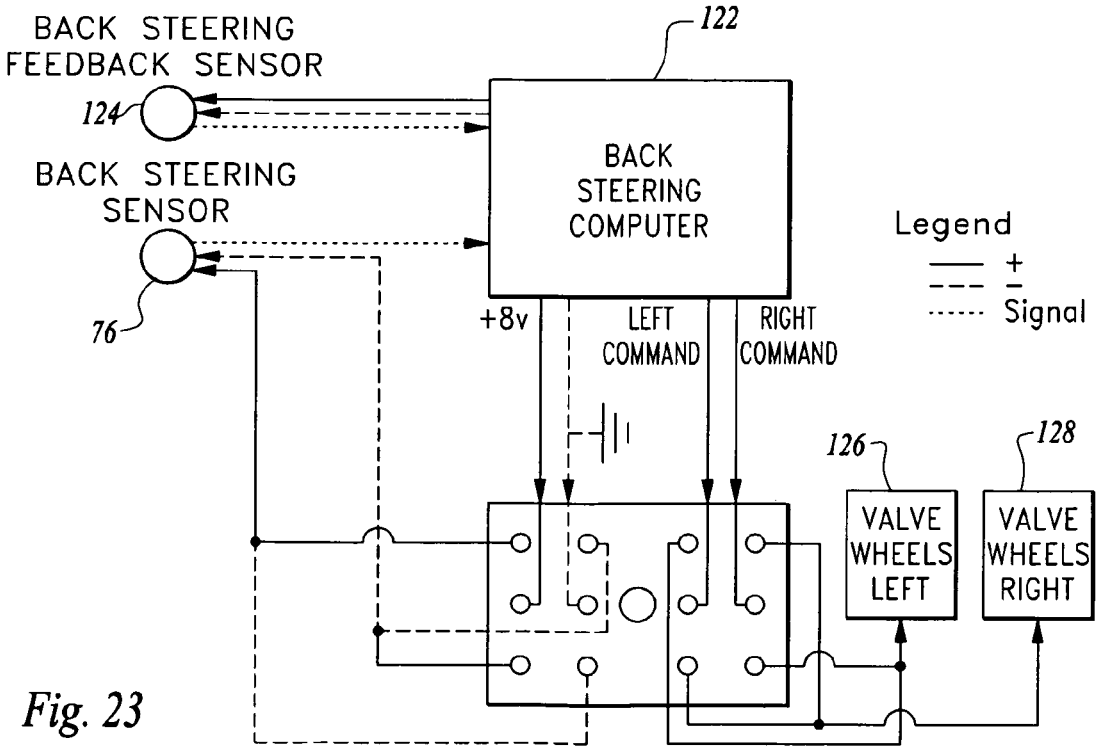
FIG. 23 is a diagrammatic presentation illustrating a back steering computer and its relationship with back steering sensors and valves of a hydraulic system employed to steer the rear support wheels.

Referring now to FIG. 23, a back steering computer 122 is operatively associated with back steering sensor 76 and back steering feedback sensor 124 which functions in much the same manner as the front steering feedback sensor 88 described above. Essentially, the back steering feedback sensor 124 sends a signal to the back steering computer 122 indicating where the rear support wheels 14 are oriented relative to a straight direction of travel. Back steering sensor 76 provides distance from line information to the back steering computer. Valves 126, 128 controlled by computer 122 turn the rear support wheels left or right responsive to the sensor signals provided.

Figure 17:
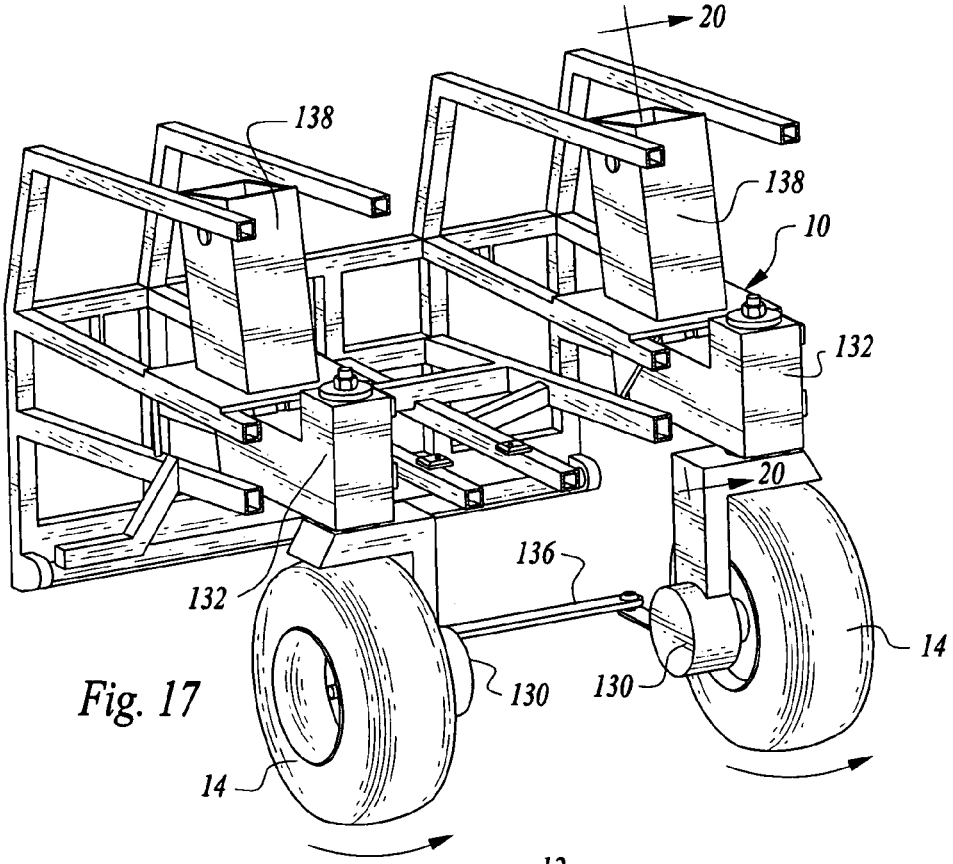
FIGS. 17-19 are perspective views of the back wheels and related structure of the apparatus, the back wheels shown in different orientations.
Figure 18:
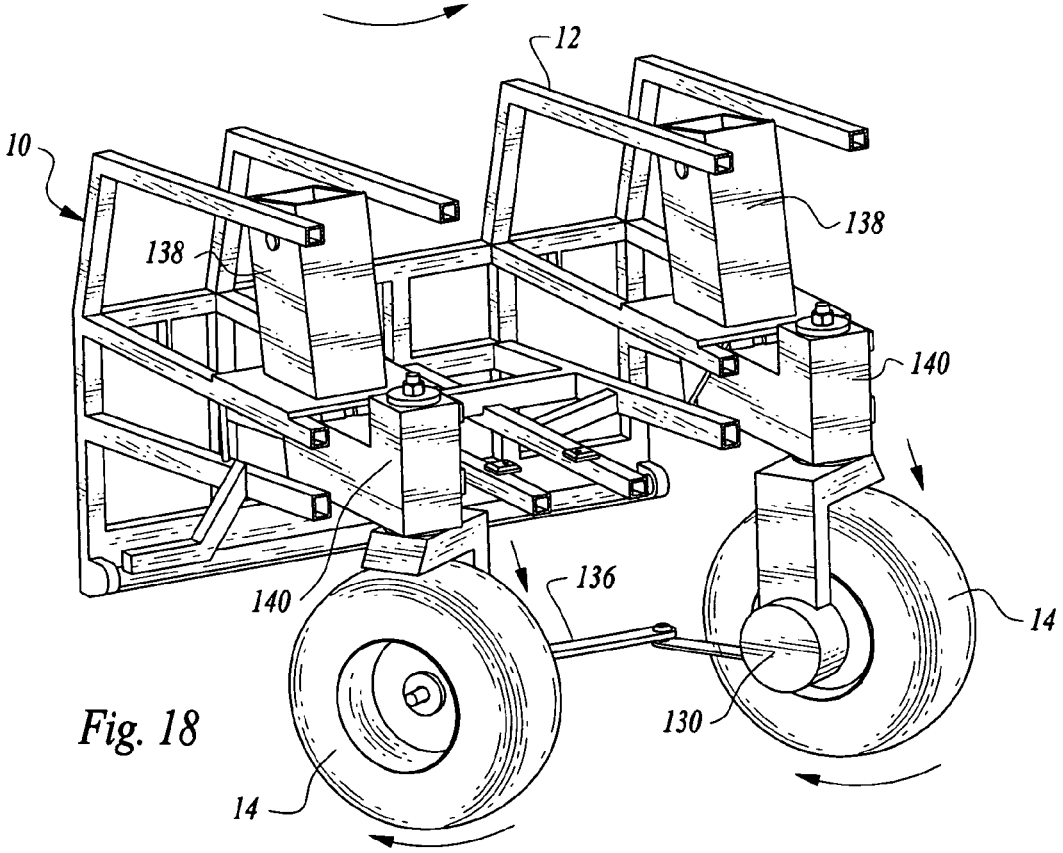
Figure 19:
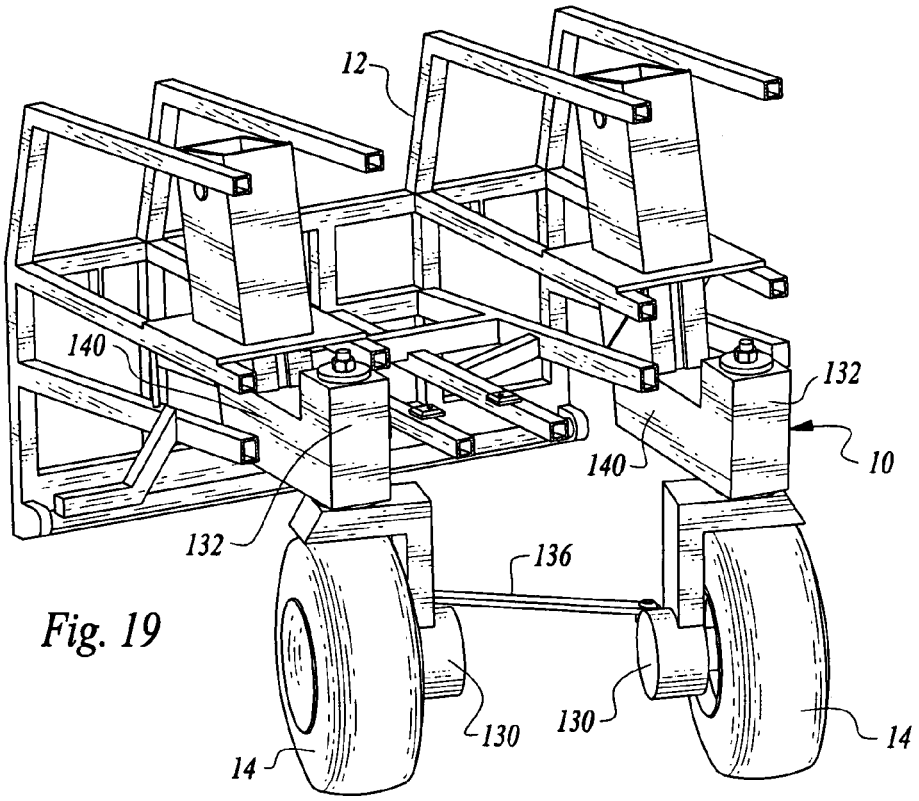
Figure 20:
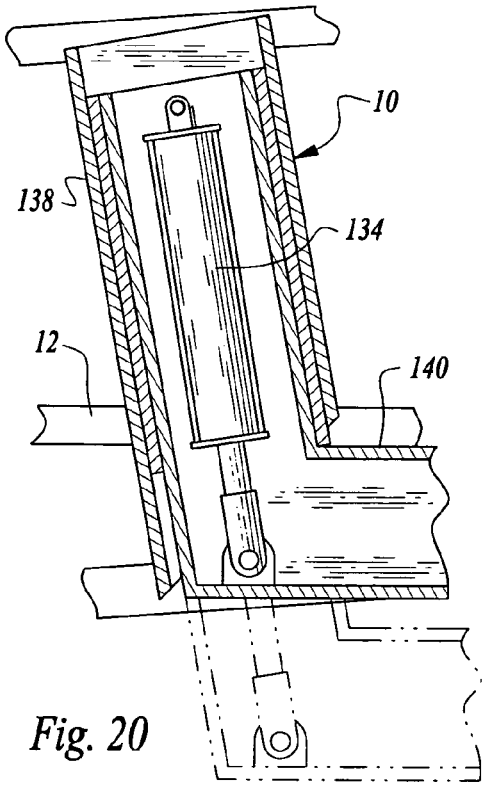
FIG. 20 is an enlarged, cross-sectional view taken along line 20-20 in FIG. 17.
Figure 21:
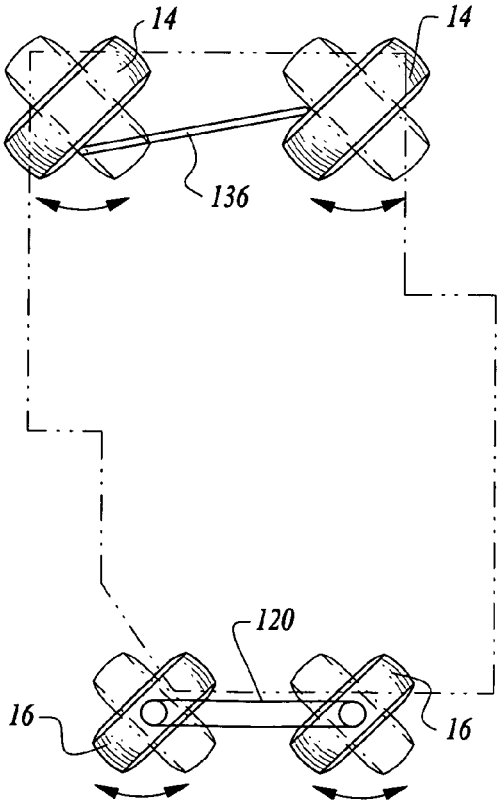
FIG. 21 is a diagrammatic, plan view showing the front wheels and back wheels turned to alternate positions.

Referring now to FIGS. 17-19, the rear support wheels 14 are driven by hydraulic motors 130 and are turned simultaneously by rotary actuators 132 controlled by the wheels left and wheels right valves just described. Mechanical linkage 136 incorporating Helm joint or tie rod connections between the rear support wheels is utilized to ensure that one of the rotary actuators 132 does not override the other and that the rear support wheels turn uniformly.

The rear support wheels 14 are independently mounted for movement relative to frame 12 so that they can be moved up or down relative to the frame 12. The rear support wheels 14 are moved up or down by a pair of hydraulic cylinders 134 (only one of which is illustrated) disposed in, and attached to, housings 138 attached to the frame. At the other end thereof the hydraulic cylinders are attached to rear wheel support structural members 140 rotatably supporting the rear wheels. Suitable known sensor structure (not shown) is employed to actuate the hydraulic cylinders 134 to maintain the frame in level condition, such sensors sensing differences in ground elevation encountered by the rear support wheels.

One or more engines, such as engine 142 in the engine compartment (see FIGS. 5 and 6), are employed to run the various hydraulic systems of apparatus 10. The engine is carried by frame 12 and disposed alongside the framework 28, the framework providing separation between the hopper 18 and the engine. As mentioned above, the engine may operate two (or more) hydraulic pumps serving different operational components of the apparatus.

The invention claimed is:

1. A self-propelled slip forming apparatus for forming a concrete curb at a selected curb site on the ground, said slip forming apparatus comprising, in combination:

a rigid frame;

front wheels and back wheels supporting said rigid frame;

a hopper having a hopper interior for receiving wet concrete;

hopper support structure located between said front wheels and said back wheels mounted on said rigid frame supporting said hopper between said front wheels and said back wheels with said hopper closer to said front wheels than to said back wheels and selectively operable to alternatively raise said hopper relative to said rigid frame or lower said hopper relative to said rigid frame;

a slip former connected to said hopper for receiving wet concrete from said hopper interior and for depositing said wet concrete on the ground to mold a curb at the selected curb site during movement of said slip forming apparatus along the ground, said slip former and said hopper being of unitary construction with said slip former extending rearwardly from said hopper, said slip former raising and lowering along with said hopper relative to said rigid frame, said rigid frame including an open topped rigid framework defining a framework interior accommodating at least a portion of said hopper, said hopper support structure including movable mechanical linkage in said open topped rigid framework attached to said hopper and at least one fluid operated cylinder connected to said mechanical linkage for moving said mechanical linkage to selectively alternatively simultaneously raise said hopper and said slip former as a unit to an upper position or simultaneously lower said hopper and said slip former as a unit to a lower position; and a grader including a grader blade and an auger rotatable relative to said grader blade supported by said rigid frame between said front wheels and said back wheels extending alongside said hopper rearwardly of said hopper, and closely adjacent to said hopper for grading the selected curb site preparatory to forming the concrete curb at the selected curb site, said grader blade including a curved grader blade wall defining an interior accommodating said auger, with a portion of said auger extending downwardly from said interior, said grader mounted for movement relative to said rigid frame and said hopper between a first position wherein said grader does not extend outwardly beyond said hopper and a second position wherein a portion of said grader extends outwardly beyond said hopper whereby said grader is positioned to engage and grade the selected curb site during movement of said slip forming apparatus along said selected curb site, the outwardly extending portion of said grader located beneath the slip former when said grader is in said second position and when said slip former and said hopper have been raised by said mechanical linkage, and said grader when in said first position being wholly to the side of said slip former and under said rigid frame when in said first position, said grader being axially slidably movable endwise and tiltable vertically relative to said rigid frame.

2. The slip forming apparatus according to claim 1 additionally comprising a prime mover structure for axially slidably moving and tilting said grader.

3. The slip forming apparatus according to claim 1 additionally comprising a hydraulic motor for rotating said auger relative to said grader blade.

4. The slip forming apparatus according to claim 1 wherein said hopper includes a selectively removable hopper end wall, said slip forming apparatus additionally comprising hopper size expansion structure for expanding the capacity of the hopper after removal of the hopper end wall.

5. The slip forming apparatus according to claim 4 wherein said hopper includes hopper side walls and wherein said hopper size expansion structure comprises side wall extensions attachable to said hopper side walls, said hopper end wall connectable to said hopper side wall extensions after attachment of said side wall extensions to said hopper side walls.

6. The slip forming apparatus according to claim 1 wherein said hopper includes two hopper side walls and first and second hopper end walls, one of said side walls defining an opening communicating with the interior of said slip former, said opening being located closely adjacent to said first hopper end wall and remote said second hopper end wall, said second hopper end wall having an upper surface for supporting a concrete delivery chute and for directing concrete from said concrete delivery chute into the interior of said hopper, and the hopper being larger at the end thereof remote from the slip former to assist in balancing out the weight of the filled hopper.

7. The slip forming apparatus according to claim 1 wherein said front wheels comprise a pair of front wheels and wherein said back wheels comprise a pair of back wheels supporting the rigid frame, said slip forming apparatus including front wheel steering structure for simultaneously steering said front wheels and back wheel steering structure for simultaneously steering said back wheels.

8. The slip forming apparatus according to claim 7 wherein said front wheel steering structure includes two rotary actuators, a separate rotary actuator being employed to steer each of said front wheels, and an endless chain or belt interconnecting said rotary actuators to prevent either one of the rotary actuators from overpowering the other so that the front wheels turn uniformly.

9. The slip forming apparatus according to claim 8 wherein said rotary actuators are located at opposed ends of a beam pivotally mounted to a hydraulic cylinder between said opposed ends, said hydraulic cylinder being connected to said rigid frame, said hydraulic cylinder being operable to simultaneously lower or raise said front wheels and rotary actuators associated therewith, the pivotal interconnection between said beam and said hydraulic cylinder allowing tilting of said beam and relative up and down movement of said front wheels to compensate for changes in ground surface configuration and substantially eliminating tilting of said hopper caused by said changes in ground surface configuration.

10. The slip forming apparatus according to claim 7 wherein said back wheel steering structure includes two rotary actuators, a separate rotary actuator being employed to steer each of said back wheels, said slip forming apparatus additionally comprising a separate hydraulic cylinder operatively associated with each of said back wheels to independently raise or lower each of said back wheels, a tie rod operatively associated with said back wheels to promote uniform turning thereof.

11. The slip forming apparatus according to claim 1 additionally comprising a height sensor attached to and extending from said rigid frame sensing the height of a string line, said mechanical linkage operable to simultaneously raise or lower said hopper and said slip former as a unit responsive to the sensed string line height.

12. The slip forming apparatus according to claim 1 additionally comprising two hydraulic pumps, one of said hydraulic pumps operatively associated with the front wheels and back wheels to propel said slip forming apparatus and the other of said hydraulic pumps operatively associated with other structural components of the slip forming apparatus.

* * * * *